US011859829B2

(12) United States Patent
Nothen et al.

(10) Patent No.: US 11,859,829 B2
(45) Date of Patent: Jan. 2, 2024

(54) COOKTOP GRATE ASSEMBLY

(71) Applicant: WHIRLPOOL CORPORATION, Benton Harbor, MI (US)

(72) Inventors: Luciano Piccini Nothen, Joinville (BR); Rodrigo Schultz, Joinville (BR); Rodrigo Tamanini, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 39 days.

(21) Appl. No.: 17/541,455

(22) Filed: Dec. 3, 2021

(65) Prior Publication Data

US 2023/0175703 A1 Jun. 8, 2023

(51) Int. Cl.
*F24C 15/34* (2006.01)
*F24C 3/08* (2006.01)

(52) U.S. Cl.
CPC ..... *F24C 15/34* (2013.01); *F24C 3/085* (2013.01)

(58) Field of Classification Search
CPC ..... F24C 15/34; F24C 15/107; F24C 15/10; F24C 3/085
USPC ..... 126/215, 152 R, 39 E, 39 K, 39 R
See application file for complete search history.

(56) References Cited

U.S. PATENT DOCUMENTS

| | | | | |
|---|---|---|---|---|
| 3,416,513 | A | 12/1968 | Fischer et al. | |
| 4,089,231 | A | 5/1978 | Segawa | |
| 4,261,327 | A | 4/1981 | Kamin | |
| 4,593,677 | A | 6/1986 | Sargunam | |
| 5,046,477 | A | 9/1991 | Bennett et al. | |
| 5,372,121 | A | 12/1994 | Castillo et al. | |
| 5,628,302 | A * | 5/1997 | Schatz | F24C 3/085 126/214 C |
| 6,470,879 | B1 | 10/2002 | Taplan | |
| 7,410,174 | B2 | 8/2008 | Jones et al. | |
| 9,612,021 | B2 | 4/2017 | Wood et al. | |
| 10,533,753 | B2 | 1/2020 | Lando et al. | |
| 2009/0044795 | A1 | 2/2009 | Shaffer et al. | |
| 2019/0226684 | A1 | 7/2019 | Sloyer | |

FOREIGN PATENT DOCUMENTS

| | | | |
|---|---|---|---|
| CN | 203815463 | U | 9/2014 |
| CN | 104075519 | A | 10/2014 |
| DE | 20101865 | U1 | 6/2001 |
| EP | 2998655 | B1 | 11/2020 |
| JP | H10220782 | A | 8/1998 |
| KR | 20060134709 | A | 12/2006 |
| KR | 101692626 | B1 | 1/2017 |
| WO | 2014142130 | A1 | 9/2014 |

* cited by examiner

*Primary Examiner* — Vivek K Shirsat
(74) *Attorney, Agent, or Firm* — Price Heneveld LLP

(57) ABSTRACT

A cooktop grate assembly includes a heat shield having an outer rim and a central plateau region offset from the outer rim by a connecting wall. The central plateau region defines an opening for receiving a burner assembly. A grate is positioned over the heat shield. The grate includes supports that extend over the central plateau region. A gasket is disposed adjacent to the heat shield. The gasket engages at least one of a base of the grate and feet of the supports to retain the grate in position relative to the heat shield.

17 Claims, 10 Drawing Sheets

COOKTOP GRATE ASSEMBLY

BACKGROUND OF THE DISCLOSURE

The present disclosure generally relates to a grate assembly, and more specifically, to a grate assembly for a cooktop.

SUMMARY OF THE DISCLOSURE

According to one aspect of the present disclosure, a cooktop grate assembly includes a heat shield having an outer rim and a central plateau region offset from the outer rim by a connecting wall. The central plateau region defines an opening for receiving a burner assembly. A grate is positioned over the heat shield. The grate includes supports that extend over the central plateau region. A gasket is disposed adjacent to the heat shield. The gasket engages at least one of a base of the grate and feet of the supports to retain the grate in position relative to the heat shield.

According to another aspect of the present disclosure, a grate assembly for a cooktop includes a heat shield with a central plateau region offset from an outer rim via a connecting wall. The heat shield has an interior surface oriented toward said cooktop and an exterior surface. A grate is selectively positioned over the heat shield. The grate includes a base disposed adjacent to the outer rim and supports extending from the base and over the central plateau region. A gasket is coupled to the heat shield. The gasket extends from proximate to the interior surface, through the heat shield, to proximate the exterior surface to engage the grate.

According to yet another aspect of the present disclosure, a grate assembly for a cooktop includes a heat shield with an outer rim and a central plateau region. The heat shield includes a curved outer edge. A grate is positioned over the heat shield. The grate includes supports and each support has feet selectively positioned adjacent to the outer rim. A gasket is disposed partially below the heat shield. The gasket defines a groove configured to receive the curved outer edge of the heat shield. The feet of the grate are positioned on projections of the gasket to retain the grate in position relative to the heat shield.

These and other features, advantages, and objects of the present disclosure will be further understood and appreciated by those skilled in the art by reference to the following specification, claims, and appended drawings.

Figure 1:
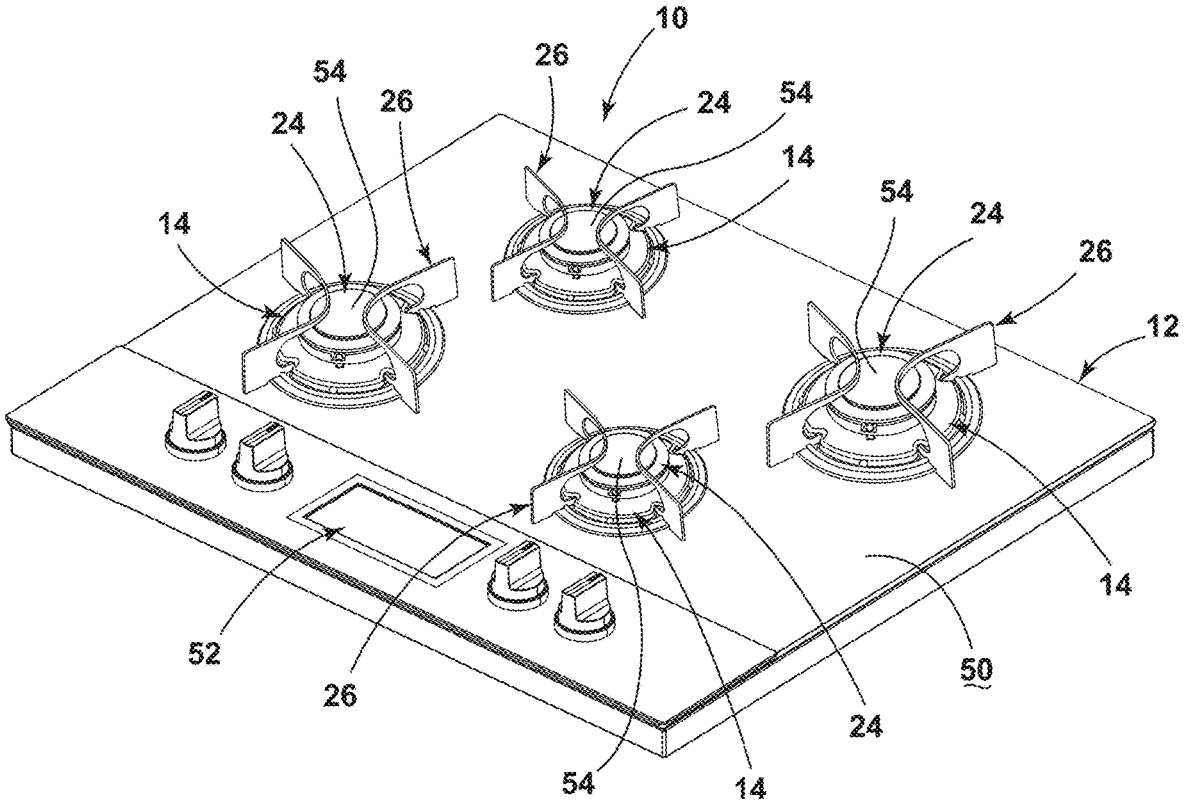
FIG. 1 is a top perspective view of a cooktop, according to the present disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a cooktop grate assembly. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

With reference to FIGS. 1-16, reference numeral 10 generally designates a grate assembly for a cooktop 12 that includes a heat shield 14 having an outer rim 16 and a central plateau region 18 offset from the outer rim 16 by a connecting wall 20. The central plateau region 18 defines an opening 22 for receiving a burner assembly 24. A grate 26 is positioned over the heat shield 14. The grate 26 includes supports 28, 30 that extend over the central plateau region 18. A gasket 32 is disposed adjacent to the heat shield 14. The gasket 32 engages at least one of a base 34 of the grate 26 and feet 36 of the supports 28, 30 to retain the grate 26 in position relative to the heat shield 14.

Referring to FIG. 1, the cooktop 12 is illustrated as a standalone unit that includes multiple burner assemblies 24. Each burner assembly 24 is associated with an individual grate assembly 10. Accordingly, each cooktop 12 includes multiple grate assemblies 10. The cooktop 12 may be constructed of a ceramic, a glass ceramic, or a glass material. The cooktop 12 may be included in a cooking appliance without departing from the teachings herein.

Figure 2:
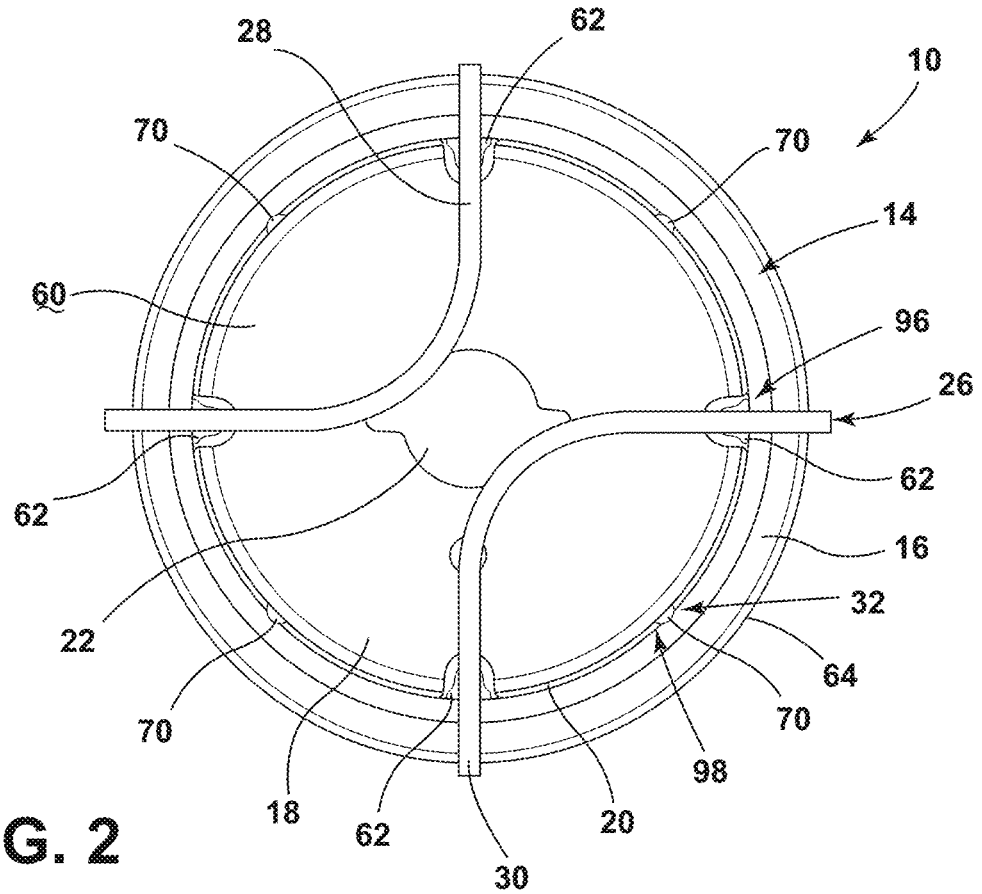
FIG. 2 is a top plan view of a grate assembly including a heat shield, a grate, and a gasket configured as wall inserts, according to the present disclosure.

With reference to FIGS. 1 and 2, each grate assembly 10 includes the heat shield 14, which is positioned on or adjacent to an upper surface 50 of the cooktop 12. The heat shields 14 may deflect or diffuse heat generated by the burner assemblies 24. The heat shields 14 may be advantageous for directing heat away from various components of the cooktop 12, including controls and electronic components 52. Each heat shield 14 includes the outer rim 16 disposed adjacent to the upper surface 50. The outer rim 16 may be disposed on the upper surface 50 or on the gasket 32 depending on the configuration of the gasket 32. Each heat shield 14 also includes the central plateau region 18, which defines the opening 22 for receiving the burner assembly 24. In certain aspects, the burner assembly 24 extends from the cooktop 12 and through the opening 22. Additionally or alternatively, a burner cap 54 of the burner assembly 24 may be positioned on or adjacent to an exterior surface 60 of the central plateau region 18 of the heat shield 14 under the supports 28, 30 of the grate 26.

The grates 26 are selectively positioned over the respective heat shields 14. In certain aspects, the grates 26 include the base 34 configured to extend around the central plateau region 18. In the illustrated configuration of FIG. 2, the base 34 of the grate 26 is a ring that follows the shape of the central plateau region 18 and the overall heat shield 14, which each defines a circular shape. The base 34 extends along the outer rim 16 adjacent to the connecting wall 20. The supports 28, 30 extend from the base 34 and are configured to extend over the central plateau region 18. The supports 28, 30 are configured to support a cooking receptacle over the burner assembly 24. The supports 28, 30 each form or define an arcuate shape. There are two supports 28, 30 in the illustrated configuration, with the supports 28, 30 being disposed on opposing sides of the opening 22. Accordingly, in certain aspects, the supports 28, 30 do not intersect with one another.

The heat shield 14 generally defines indents 62 in which feet 36 of the supports 28, 30 of the grate 26 at least partially extend. The feet 36 are generally disposed on or adjacent to the outer rim 16 of the heat shield 14 and partially within the indents 62 defined by the heat shield 14. The feet 36 of the supports 28, 30 provide additional stability to the grate 26. Additionally, the feet 36 may extend beyond an outer edge 64 of the heat shield 14 and onto or over the upper surface 50 of the cooktop 12. In various examples, the indents 62 provide a visual indicator for aligning the grate 26 relative to the heat shield 14. The indents 62 may also assist in retaining the position of the grate 26 relative to the heat shield 14.

Figure 3:
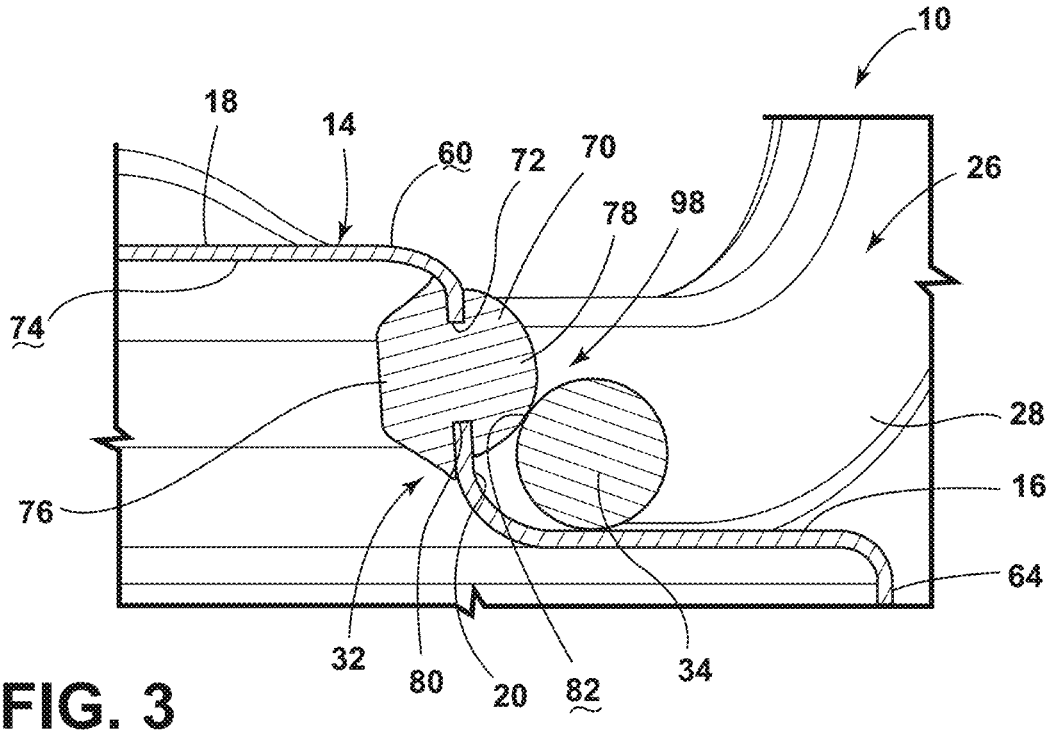
FIG. 3 is a partial cross-sectional view of an engagement between an insert extending through a heat shield and a base of a grate, according to the present disclosure.
Figure 4:
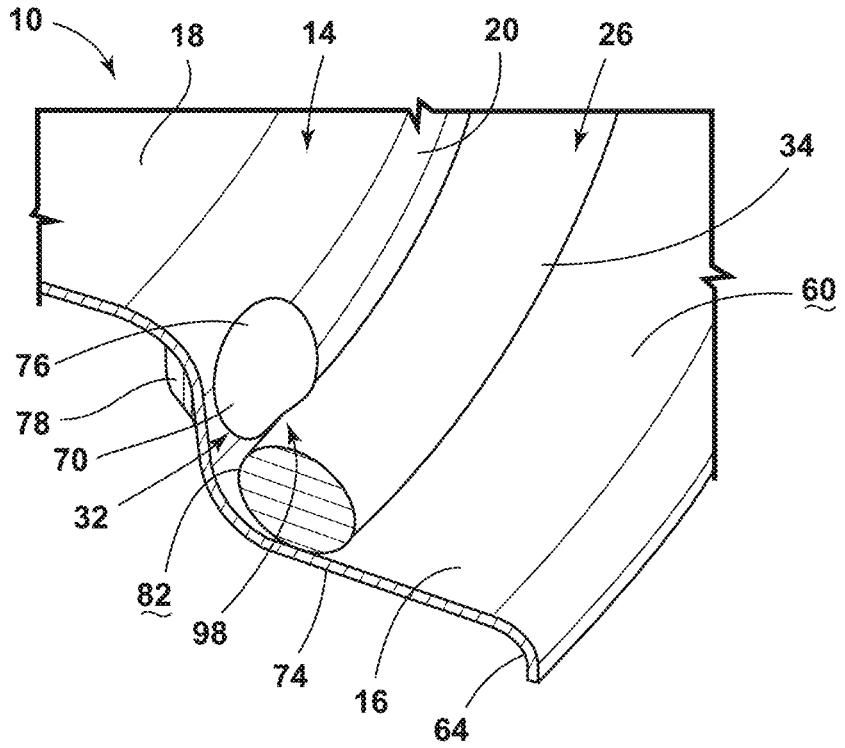
FIG. 4 is a partial cross-sectional perspective view of an engagement between an insert and a base of a grate, according to the present disclosure.

With reference still to FIG. 2, as well as FIGS. 3 and 4, each grate assembly 10 includes the gasket 32 configured to retain the grate 26 in position relative to the heat shield 14. The gasket 32 is configured to lock the grate 26 in the selected position, thereby reducing movement of the grate 26, which consequently stabilizes the grate 26. As illustrated in FIGS. 2-4, the gasket 32 is configured as a plurality of wall inserts 70, which are configured to extend through the heat shield 14 to engage the grate 26. The illustrated grate assembly 10 includes four wall inserts 70; however, any practicable number of wall inserts 70 may be utilized without departing from the teachings herein.

The connecting wall 20 of the heat shield 14 defines apertures 72 spaced at intervals around the heat shield 14. The apertures 72 may be positioned at substantially equal intervals about the connecting wall 20 or at any select locations. Each wall insert 70 extends through one of the respective apertures 72 defined by the connecting wall 20. In this way, each wall insert 70 is disposed at least partially under the heat shield 14 proximate to an interior surface 74 of the heat shield 14 and partially outside of the heat shield 14 proximate to the exterior surface 60.

An interior portion 76 of the wall insert 70 abuts the interior surface 74 of the connecting wall 20, while an exterior portion 78 of the wall insert 70 abuts the exterior surface 60 of the connecting wall 20. The interior portion 76 and the exterior portion 78 are separated by a ledge or a groove 80. In examples with the grooves 80, the grooves 80 is configured to receive the heat shield 14 to retain the wall inserts 70 within the apertures 72 of the connecting wall 20. In examples with the ledge, the ledge may abut one of the exterior surface 60 and the interior surface 74 of the heat shield 14 to prevent the wall insert 70 from moving further through the aperture 72.

Referring still to FIGS. 2-4, the exterior portion 78 protrudes from the connecting wall 20 to engage the grate 26. Generally, the wall insert 70 engages an inner surface 82 of the base 34. The wall inserts 70 extend between the heat shield 14 and the base 34 of the grate 26 to provide an interference or frictional engagement with the grate 26, which is configured to retain the grate 26 in position relative to the heat shield 14. As best illustrated in FIG. 3, when the base 34 is positioned on the outer rim 16, the base 34 may engage the wall inserts 70 and also be positioned substantially below the wall inserts 70. In this configuration, the base 34 has to move past a substantial portion of the wall inserts 70 to disengage from the heat shield 14, which provides greater stability and reduces movement of the grate 26.

As illustrated in FIGS. 3 and 4, the exterior portions 78 of the wall inserts 70 may form a substantially hemispherical shape. The rounded shape may be advantageous for coupling the wall inserts 70 with the connecting wall 20. Additionally, the rounded configuration of the exterior portion 78 may be advantageous for moving the grate 26 past the wall inserts 70 and on the heat shield 14. For example, the rounded shape may provide less resistance when positioning the grate 26 on the outer rim 16 of the heat shield 14.

Figure 5:
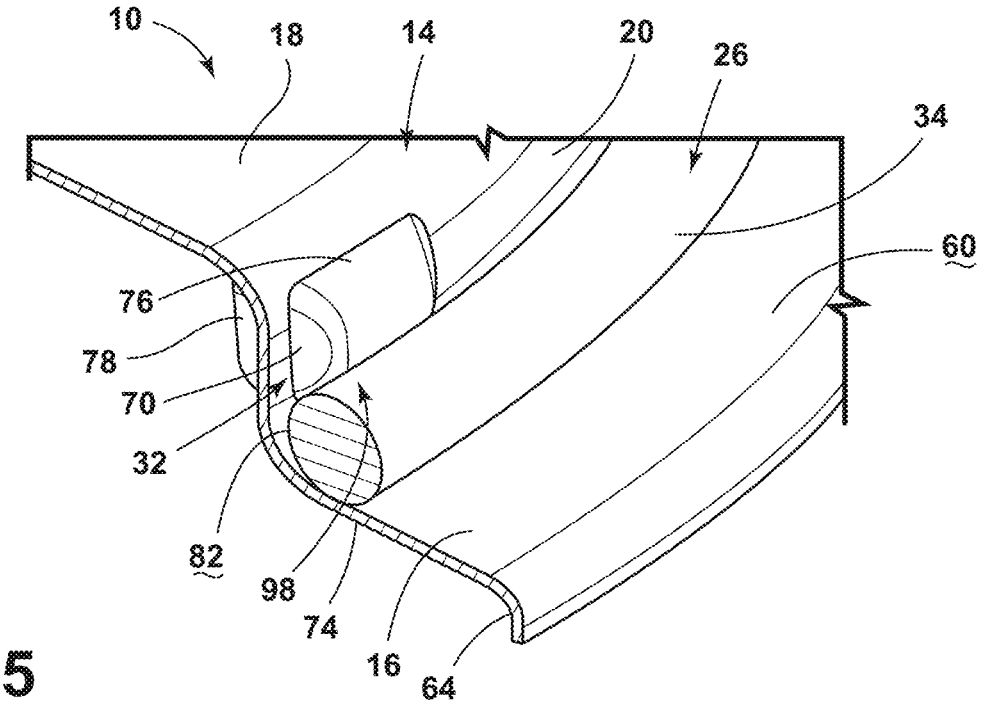
FIG. 5 is a partial cross-sectional perspective view of an engagement between an elongated insert and a base of a grate, according to the present disclosure.

Referring now to FIG. 5, an additional or alternative configuration of the wall insert 70 is illustrated. The illustrated wall insert 70 is elongated, having a more rectangular configuration. The elongated wall insert 70 extends generally parallel with the outer rim 16 of the heat shield 14, which may provide an increased surface area for the grate 26 to engage. The increased surface area may provide a greater interference or frictional engagement for retaining the grate 26 in position relative to the heat shield 14. Each grate assembly 10 may include the more spherical wall inserts 70 illustrated in FIGS. 2-4, the prism wall inserts 70 illustrated in FIG. 5, or a combination thereof.

Figure 6:
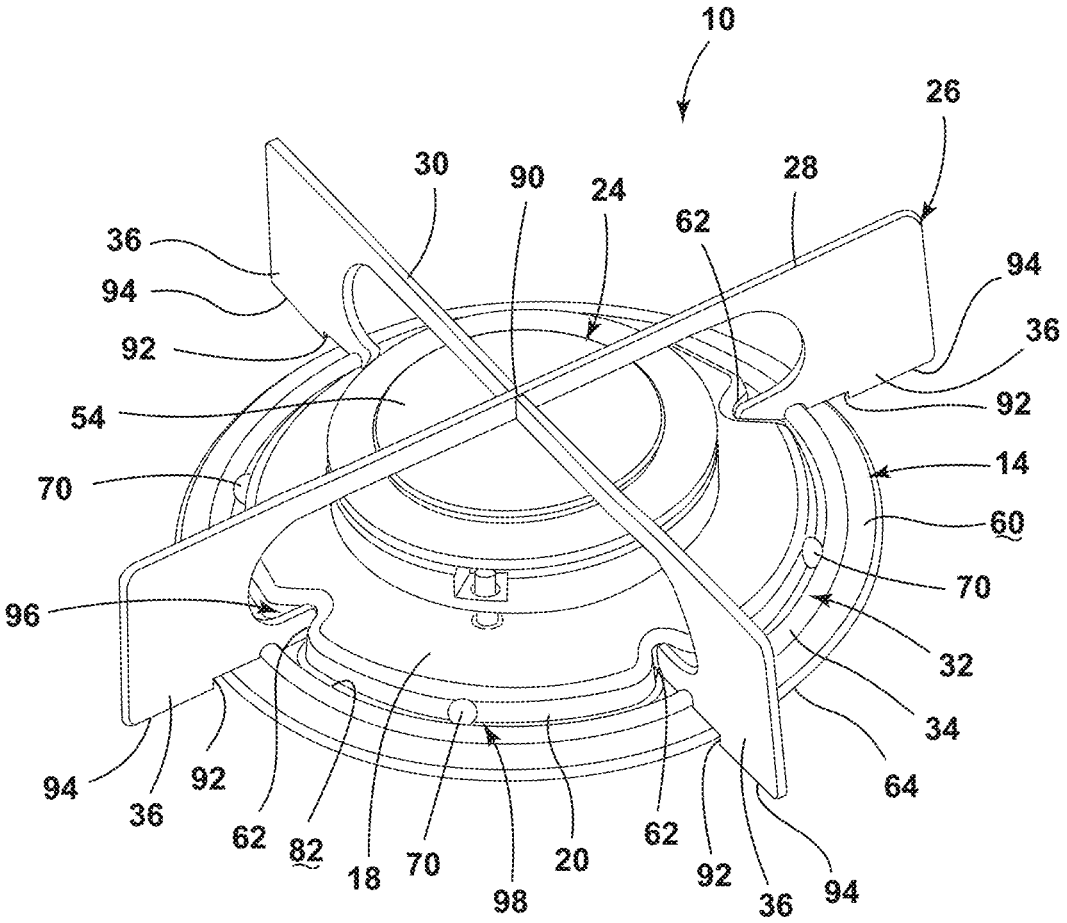
FIG. 6 is a side perspective view of a grate assembly including a heat shield, a grate, and a gasket configured as wall inserts, according to the present disclosure.
Figure 7:
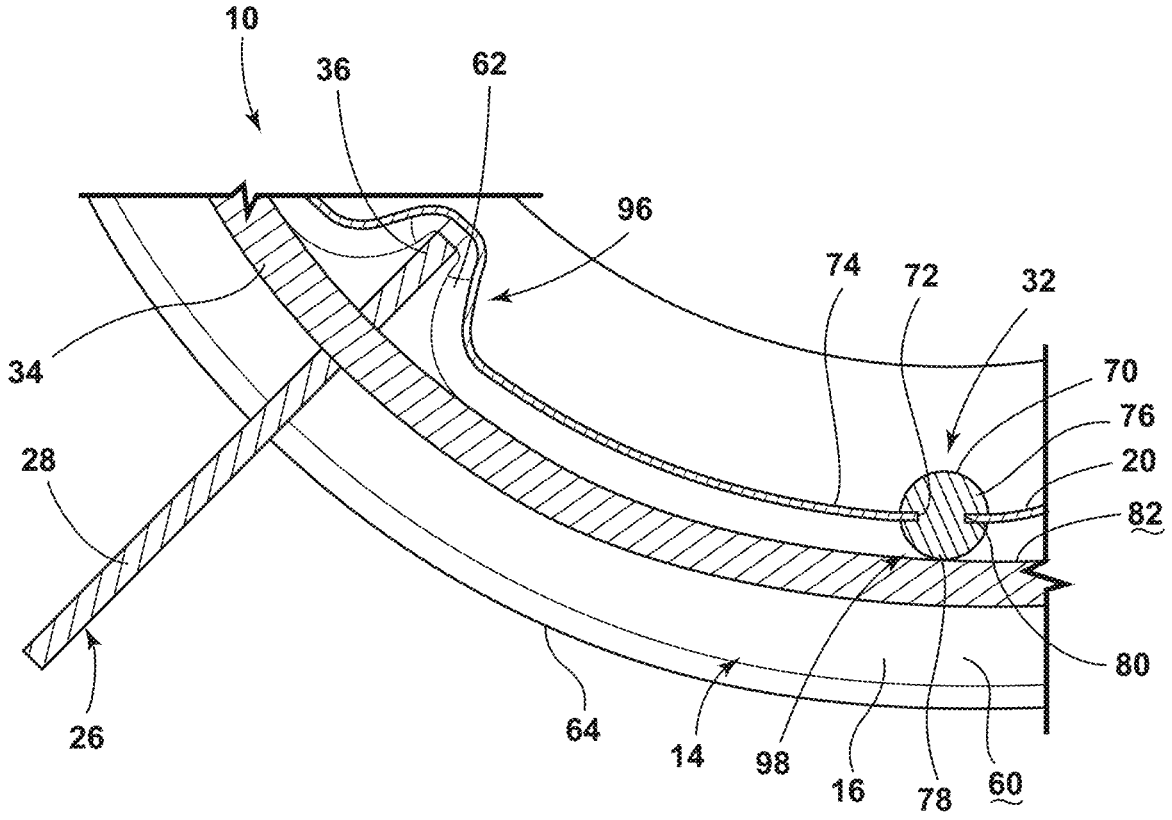
FIG. 7 is a cross-sectional top plan view of engagements between a grate, a heat shield, and wall inserts, according to the present disclosure.
Figure 8:
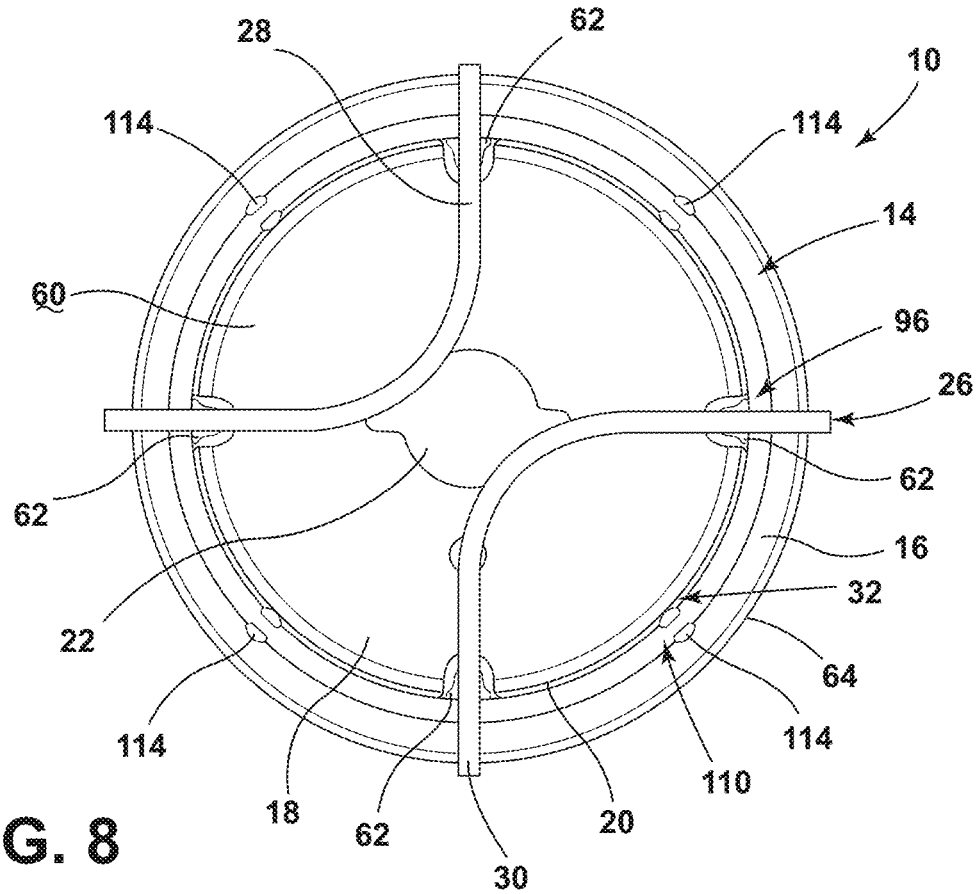
FIG. 8 is a top plan view of a grate assembly including a heat shield, a grate, and a gasket configured as a sealing insert, according to the present disclosure.
Figure 9:
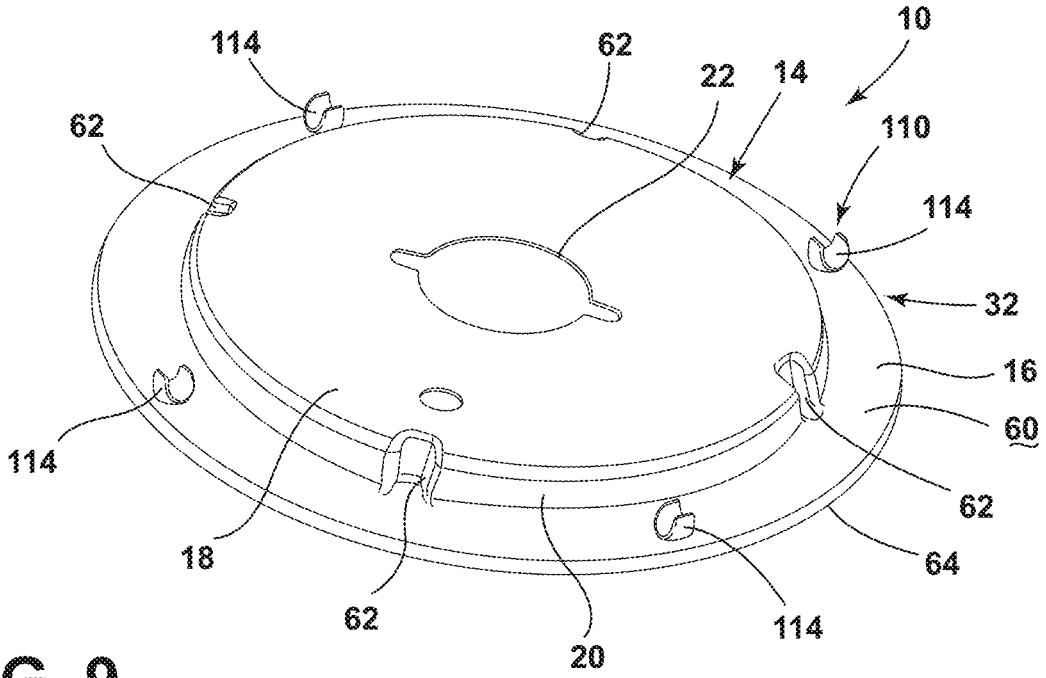
FIG. 9 is a side perspective view of a heat shield with a sealing insert extending therethrough, according to the present disclosure.

Referring to FIGS. 6 and 7, an additional or alternative configuration of the grate 26 is illustrated. The grate 26 includes the base 34 that is positioned on the outer rim 16 and extends along the connecting wall 20. The supports 28, 30 extend from the base 34 and are configured to extend over the central plateau region 18. As illustrated in FIG. 6, the burner cap 54 of the burner assembly 24 is positioned on or adjacent to the exterior surface 60 of the central plateau region 18 below an intersection point 90 of the supports 28, 30.

The supports 28, 30 extend across to the central plateau region 18 and couple with the base 34 on opposing sides of the burner assembly 24. The supports 28, 30 intersect with one another over the burner assembly 24. The supports 28, 30 each have feet 36 that extend into the indents 62, over the outer rim 16, and onto the upper surface 50 of the cooktop 12. In various examples, the feet 36 define a step 92, forming two different portions of a bottom 94 of the feet 36. The step 92 allows a first portion of the bottom 94 of the feet 36 to be positioned on the upper surface 50 of the cooktop 12 (FIG. 1) and the second portion to be positioned on the outer rim 16 of the heat shield 14. The feet 36 assist with aligning the grate 26 relative to the heat shield 14, as well as stabilizing the grate 26.

Referring to FIGS. 2-7, the indents 62 and the apertures 72 of the heat shield 14 generally alternate with one another. In the illustrated configurations, the heat shield 14 defines four indents 62 and four apertures 72. Each aperture 72 is positioned between two adjacent indents 62. Accordingly, the grate 26 engages the heat shield 14 within the indents 62 and the wall inserts 70 engage the grates 26 between the feet 36. This configuration provides multiple engagement points between the grate 26 and the heat shield 14, as well as multiple engagement points between the grate 26 and the wall inserts 70 to increase the stability of the grate 26.

The wall inserts 70 extend through the heat shield 14 to engage the grate 26 to retain the grate 26 in position relative to the heat shield 14. Additionally, the wall insert 70 may be constructed of an elastically deformable material, such as rubber or silicone, to provide the interference or frictional engagement with the grate 26. When the grate 26 is disposed on the outer rim 16, the wall inserts 70 may be slightly deformed by the base 34. The wall inserts 70 may apply a biasing force from the elastically deformable material toward the base 34 of the grate 26 when deformed, which assists in maintaining the engagement between the wall inserts 70 and the grate 26.

In certain aspects, the wall inserts 70 may be constructed as spring-loaded pins. In such configurations, a spring may be disposed under the heat shield 14 and the pins may extend through the apertures 72 to engage the grate 26. The pins may be adjusted against a biasing force of the spring when engaged with the grate 26. Additional or alternative configurations of the wall inserts 70 may be utilized in the grate assembly 10 without departing from the teachings herein.

With reference now to FIGS. 8-13, an additional or alternative configuration of the grate assembly 10 is illustrated. The heat shield 14 includes the central plateau region 18 defining the opening 22 for the burner assembly 24. The heat shield 14 also includes the outer rim 16 coupled to the central plateau region 18 via the connecting wall 20. Further, the heat shield 14 defines the indents 62 for receiving the feet 36 of the grate 26. In this configuration, the connecting wall 20 may be free of the apertures 72 (FIG. 3) while the outer rim 16 defines apertures 116 spaced about the central plateau region 18. In the illustrated configuration, the outer rim 16 defines four apertures 116.

In the example illustrated in FIGS. 8-13, the gasket 32 is configured as a sealing insert 110. The sealing insert 110 includes a seal member 112 and retention features 114 extending from the seal member 112. The seal member 112 is configured to be disposed below the outer rim 16 of the heat shield 14 adjacent to the interior surface 74. The heat shield 14 may be disposed at least partially on the seal member 112. Additionally or alternatively, the outer edge 64 of the heat shield 14 may curve to engage the upper surface 50 of the cooktop 12 (FIG. 1) adjacent to the seal member 112, which may be advantageous for concealing the seal member 112 below the heat shield 14.

The sealing insert 110 provides the seal member 112 between the heat shield 14 and the upper surface 50 of the cooktop 12 (FIG. 1), which operates to minimize or prevent liquids and other food items from moving below the heat shield 14 or into an interior of the cooktop 12 (FIG. 1). The seal member 112 extends adjacent to the outer edge 64 of the heat shield 14. The heat shield 14 generally defines a geometric shape, which is a circle in the illustrated examples. The seal member 112 defines a substantially similar or the same geometric shape as the heat shield 14, thereby forming a ring under the heat shield 14. The corresponding geometric shapes may be advantageous for providing the seal entirely around the heat shield 14.

Referring still to FIGS. 8-13, the sealing insert 110 includes the retention features 114 extending from the seal member 112. The retention features 114 are spaced from one another and extend vertically from the seal member 112. In the illustrated configuration, four retention features 114 extend from the seal member 112, which corresponds with the number of apertures 116 defined in the outer rim 16. It is contemplated that any number of retention features 114 and corresponding apertures 116 may be utilized without departing the teachings herein.

Figure 11:
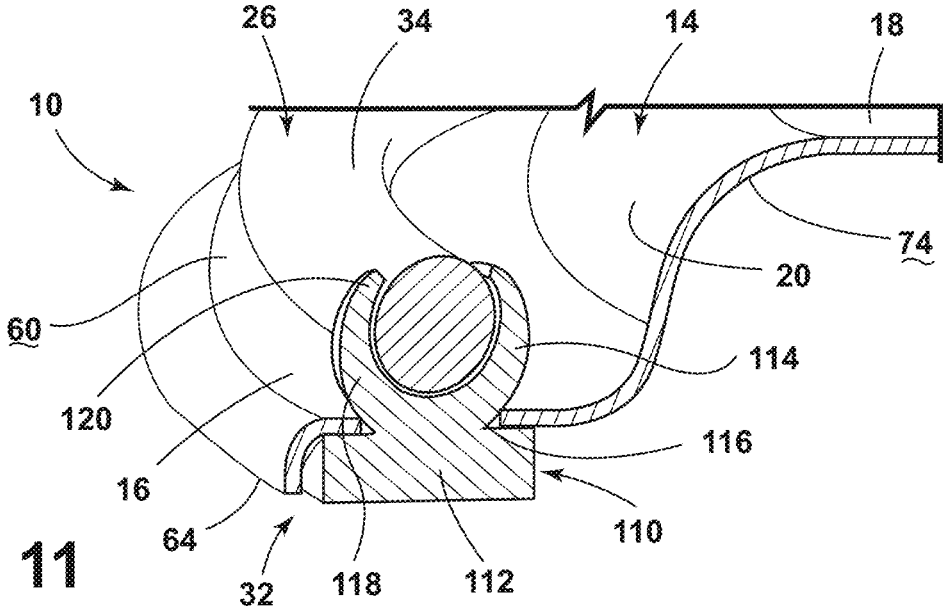
FIG. 11 is a partial cross-sectional perspective view of a sealing insert extending through a heat shield to engage a base of a grate, according to the present disclosure.

As best illustrated in FIG. 11, the seal member 112 is disposed below the outer rim 16 adjacent to the outer edge 64 of the heat shield 14, and the retention features 114 extend through the apertures 116 to be disposed adjacent to the exterior surface 60 of the outer rim 16. The retention features 114 form protrusions extending vertically from the outer rim 16. The retention features 114 are generally U-shaped, with the base 34 of the grate 26 configured to be disposed in and retained by the U-shaped retention features 114. In various examples, at least the base 34 of the grate 26 may not directly contact the heat shield 14, but the base 34 is supported by the retention features 114 spaced from the outer rim 16. In certain aspects, the base 34 being supported on the retention features 114 may minimize or prevent direct contact between the remainder of the grate 26 with the heat shield 14, the grate 26 with the upper surface 50 of the cooktop 12 (FIG. 1), or a combination thereof. Reducing direct contact with the heat shield 14 may increase the longevity of the grate assembly 10 and may also reduce heat transfer to the grate 26.

Figure 10:
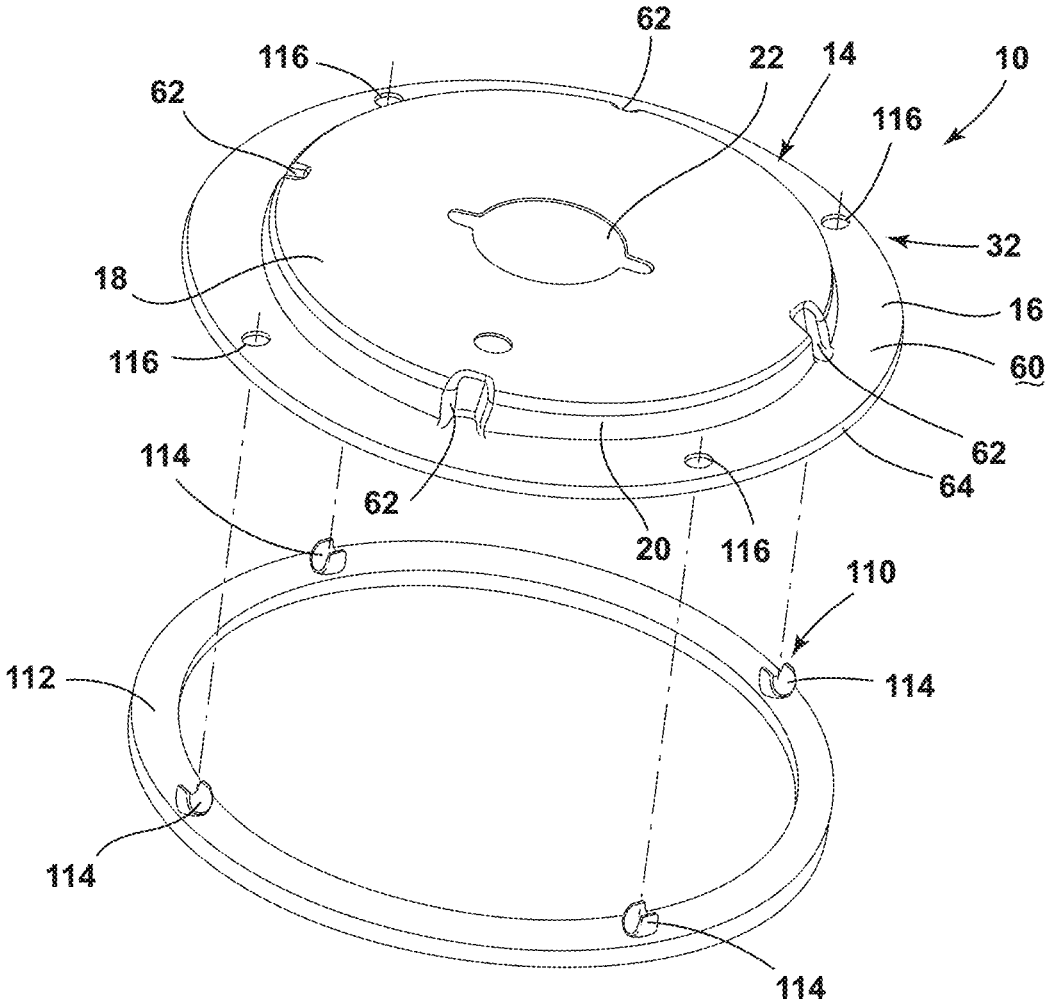
FIG. 10 is an exploded side perspective view of a heat shield and a sealing insert having a seal member and retention features, according to the present disclosure.
Figure 12:
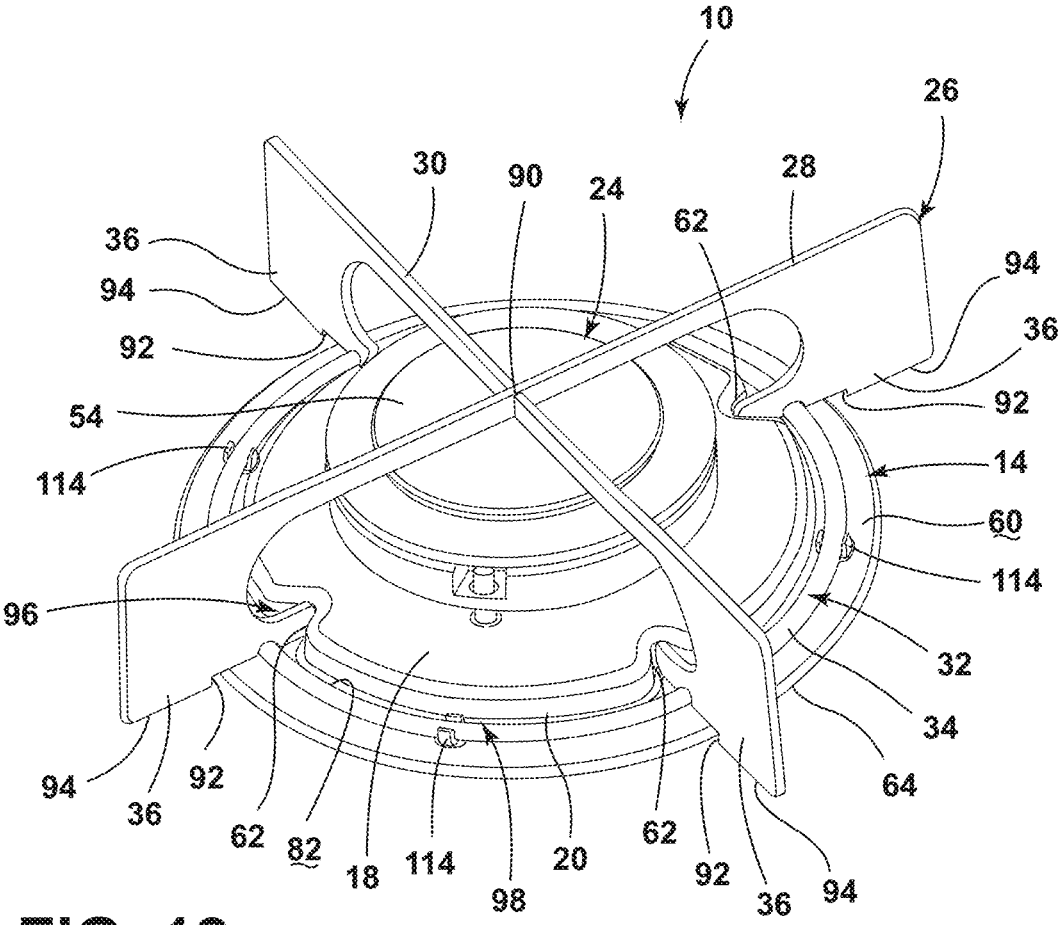
FIG. 12 is a side perspective view of a grate assembly including a heat shield, a grate, and a sealing insert, according to the present disclosure.
Figure 13:
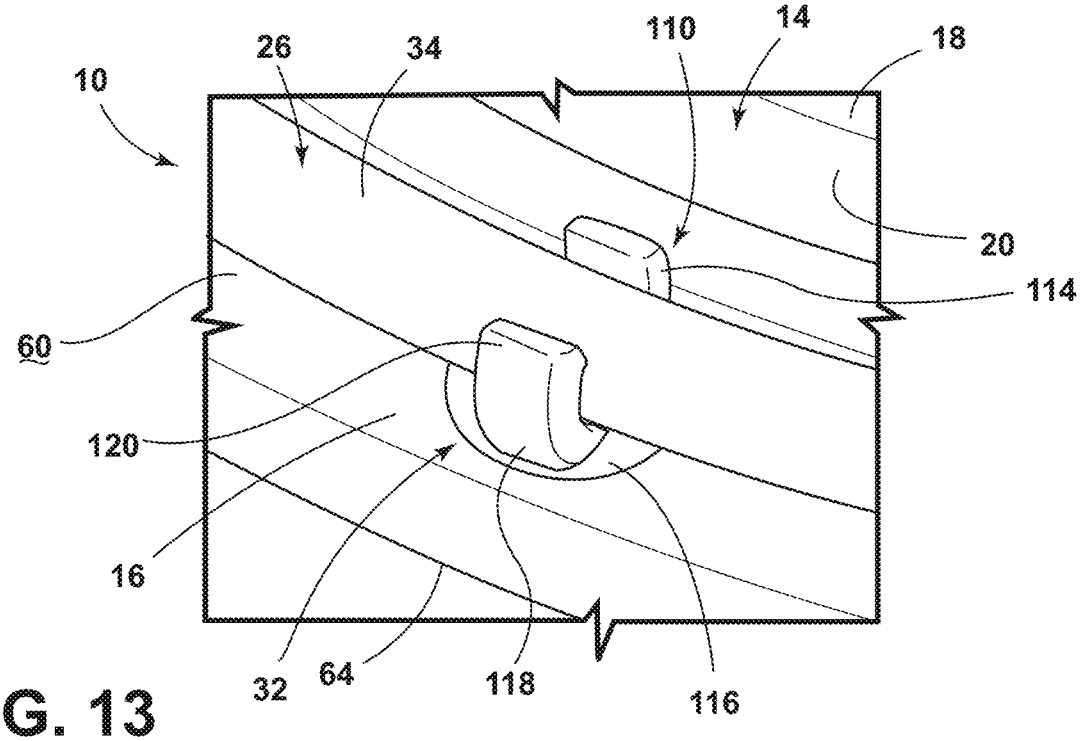
FIG. 13 is a partial enlarged side perspective view of an engagement between a retention feature of a sealing insert and a base of a grate, according to the present disclosure.

The retention features 114 are generally elastically deformable, being constructed of, for example, rubber or silicone. The retention features 114 may be biased to form a smaller space than is utilized by the base 34 of the grate 26 (e.g., smaller than the size of the base 34). In this way, positioning the base 34 on the retention features 114 expands the retention features 114 and thereby forms an interference or frictional engagement between the grate 26 and the sealing insert 110. The retention features 114 may taper from a proximal end 118 coupled to the seal member 112 to a distal end 120, as best illustrated in FIGS. 10 and 11. Alternatively, the retention features 114 may have the same width or thickness from the proximal end 118 to the distal end 120, as best illustrated in FIGS. 12 and 13, which may increase the surface area that engages with the base 34 of the grate 26.

The grate 26 is positioned over the outer rim 16 and within each of the retention features 114. The retention features 114 operate to hold the grate 26 in position relative to the heat shield 14. Additionally or alternatively, as the seal member 112 is disposed on opposing sides of the outer rim 16, the engagement between the retention features 114 and the grate 26 may operate to couple the grate 26 to the heat shield 14.

Referring again to FIGS. 8-13, the grate assembly 10 includes multiple engagement locations 96 between the grate 26 and the heat shield 14 when the feet 36 of the grate 26 are at least partially within the indents 62. Further, the grate assembly 10 includes multiple engagement locations 98 between the sealing insert 110 and the grate 26. The engagement locations 96 between the grate 26 and the heat shield 14 alternate with the engagement locations 98 between the grate 26 and the sealing insert 110. In this way, each retention feature 114 engages the base 34 of the grate 26 between two adjacent feet 36 of the supports 28, 30. The alternating engagement locations 96, 98 may provide additional stability to the grate assembly 10.

Figure 14:
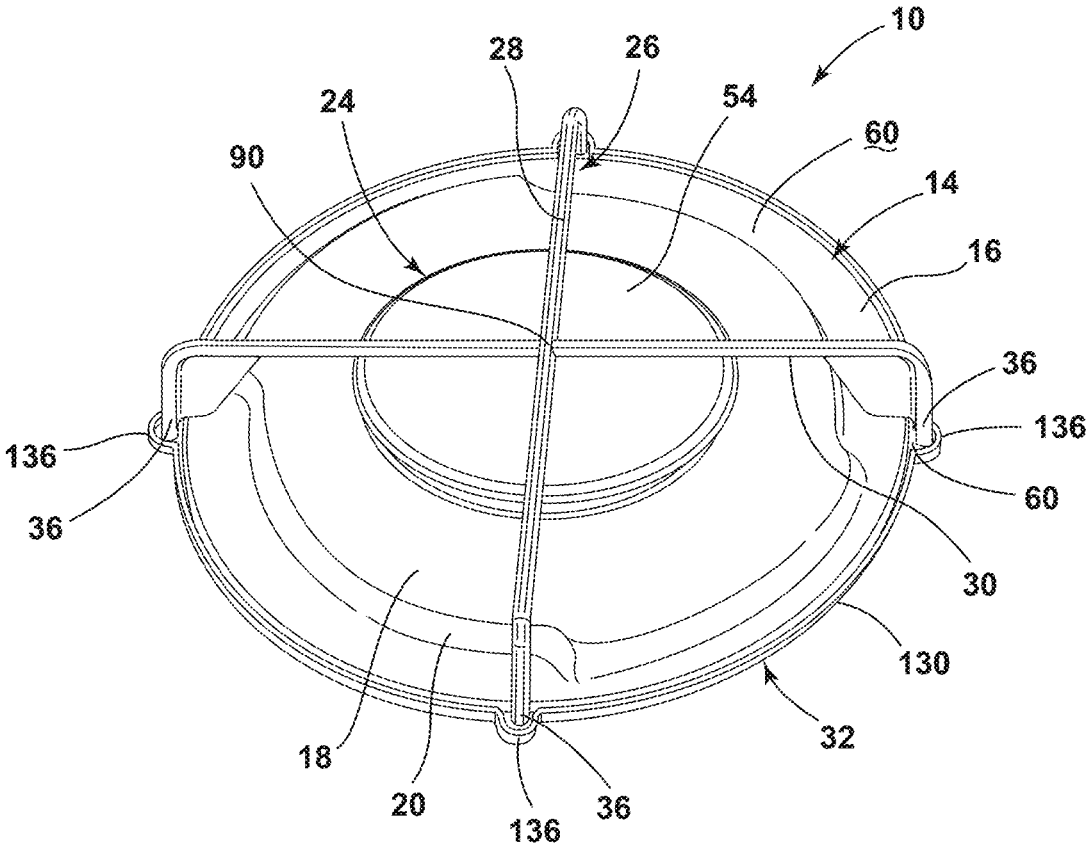
FIG. 14 is a side perspective view of a grate assembly including a heat shield, a grate, and a gasket configured as a border member, according to the present disclosure.
Figure 15:
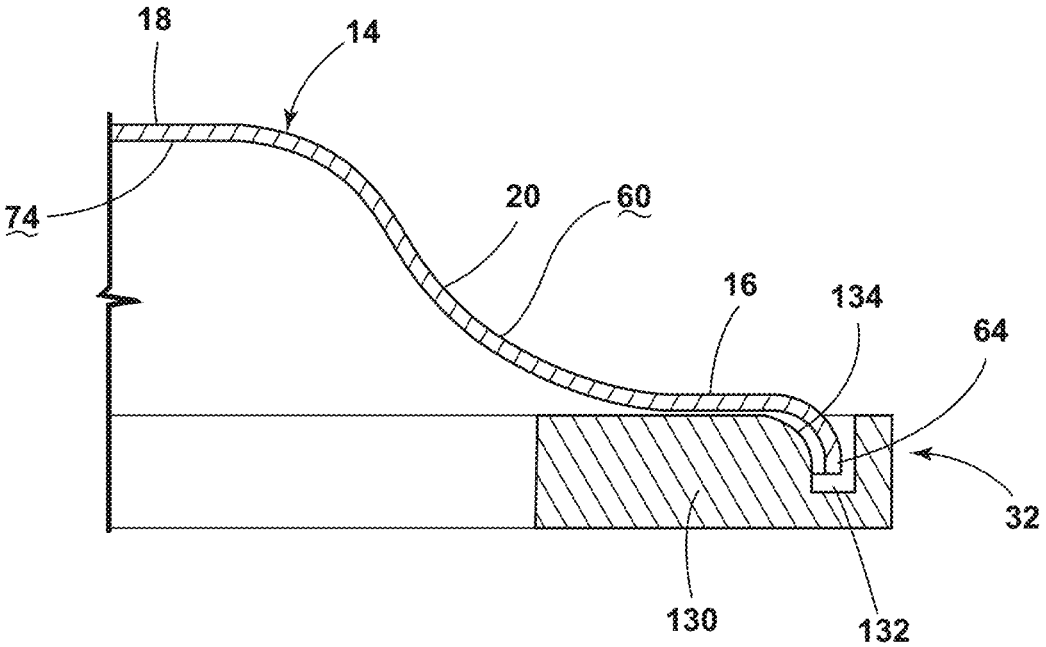
FIG. 15 is a partial cross-sectional view of an outer edge of a heat shield positioned within a groove of a border member.
Figure 16:
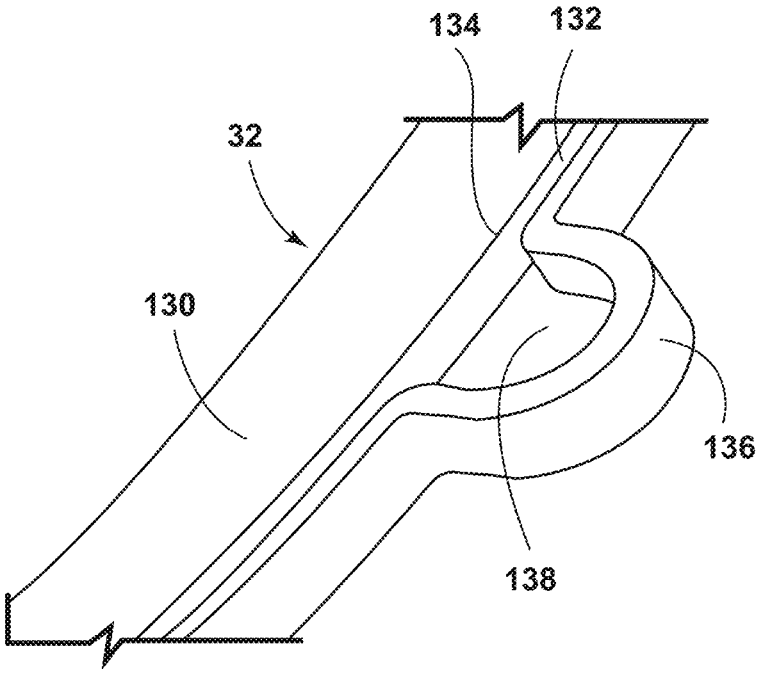
FIG. 16 is a partial side perspective view of a border member including a projection defining a recess, according to the present disclosure.

Referring now to FIGS. 14-16, an additional or alternative configuration of the grate assembly 10 is illustrated. The heat shield 14 includes the central plateau region 18 defining the opening 22 (FIG. 2) for the burner assembly 24, the outer rim 16, and the connecting wall 20. In this configuration, the connecting wall 20 and the outer rim 16 have substantially continuous surfaces (e.g., are free of the apertures 72 as best illustrated in FIG. 3 and the apertures 116 as best illustrated in FIG. 10). The central plateau region 18 may have a more oblong shape, having portions that extend closer to the outer edge 64 compared to other configurations of the grate assembly 10 disclosed herein.

The grate 26 is disposed over the burner assembly 24. In the illustrated configuration, the grate 26 includes the supports 28, 30, which intersect with one another over the burner assembly 24. The feet 36 are positioned beyond the outer edge 64 of the heat shield 14. Further, in the illustrated configuration, the heat shield 14 is free of the indents 62 and the grate 26 is free of the base 34 (FIG. 2). However, it is contemplated that the indents 62 in the heat shield 14 and the base 34 of the grate 26 may be included without departing from the teachings herein. In such examples, the feet 36 may extend into the indents 62 of the heat shield 14, over the outer rim 16, and beyond the outer edge 64. Further, the base 34 may extend around the central plateau region 18, having a more oblong shape to correspond with the shape of the central plateau region 18.

In the example illustrated in FIGS. 14-16, the grate assembly 10 includes the gasket 32 configured as a border member 130. The border member 130 is configured to extend along the perimeter of the heat shield 14. The heat shield 14 defines the geometric shape, which is illustrated as a circular shape. The border member 130 defines a substantially similar or the same geometric shape, thereby forming a ring to extend along the outer edge 64 of the heat shield 14.

The border member 130 is configured to be disposed on the upper surface 50 of the cooktop 12 (FIG. 1). The border member 130 defines a groove 132, which is generally an annular groove 132, that is configured to receive the outer edge 64 of the heat shield 14. The outer edge 64 of the heat shield 14 defines a curve configured to be inserted into and retained in the groove 132. The border member 130 is positioned between the upper surface 50 of the cooktop 12 and the heat shield 14, such that the heat shield 14 does not have direct contact with the upper surface 50. The border member 130 is configured to be disposed partially under the heat shield 14 adjacent to the interior surface 74 and partially outside the heat shield 14 adjacent to the exterior surface 60.

As best illustrated in FIG. 15, a greater portion of the border member 130 may be disposed under the heat shield 14 than outside of the heat shield 14 to conceal a greater portion of the border member 130 from view. The border member 130 may define an upper curved portion 134 that corresponds with the curve of the outer edge 64 of the heat shield 14. The heat shield 14 may then be positioned on and follow the upper curved portion 134 as the heat shield 14 extends into the groove 132. The engagement between the upper curved portion 134 and the heat shield 14 may assist in retaining the heat shield 14 in position relative to the border member 130. For example, a frictional engagement can be formed between the upper curved portion 134 of the border member 130 and the outer rim 16 to reduce movement of the heat shield 14.

The border member 130 is generally elastically deformable, being constructed of, for example, rubber or silicone. In certain aspects, the groove 132 may be smaller in width than a thickness of the outer edge 64 of the heat shield 14. In this way, insertion of the heat shield 14 into the groove 132 may slightly deform the border member 130 and provide an interference or frictional fit between the border member 130 and the outer edge 64 of the heat shield 14. Alternatively, the groove 132 may be slightly wider in width or diameter than the outer edge 64, which may cause compression of the border member 130 and a biasing force against the outer edge 64 to maintain the engagement between the heat shield 14 and the border member 130. It is also contemplated the groove 132 may have a slightly narrower width or diameter than the outer edge 64, causing an expansion of the border member 130 when engaged with the heat shield 14. A biasing force from the border member 130 due to the deformation, compression, or expansion may couple the retaining border to the heat shield 14.

Referring still to FIGS. 14-16, the border member 130 forms a seal between the heat shield 14 and the upper surface 50 of the cooktop 12. The border member 130, generally configured as a ring, provides the seal along the perimeter of the heat shield 14. The configuration of the border member 130 providing the seal may be advantageous for minimizing or preventing liquids and food items from moving below the heat shield 14 or into the cooktop 12.

The border member 130 includes outwardly extending projections 136. When the border member 130 is configured as the ring, the projections 136 are generally radially extending projections 136. In the illustrated configuration, the border member 130 includes four projections 136 spaced apart from one another along the perimeter of the heat shield 14. The border member 130 may include any practicable number of projections 136 and may include as many projections 136 as the number of feet 36 included in the grate 26.

The projections 136 each define a recess 138, which are in fluid communication with the groove 132 and may be outward extensions of the groove 132. The feet 36 of the grate 26 are configured to be positioned on the projections 136, generally within the recesses 138. The projections 136 may be deformed as the feet 36 are positioned within the recesses 138 to provide the interference or frictional engagement with the grate 26. Additionally or alternatively, the material of the projections 136 may also provide the interference or frictional engagement with the bottom 94 of the feet 36. The projections 136 generally prevent direct contact between the grate 26 and the upper surface 50 of the cooktop 12. The engagement between the grate 26 and the projections 136 also provides additional stability to the grate 26 by reducing movement of the grate 26 relative to the heat shield 14 and the cooktop 12 (FIG. 1).

Referring again to FIGS. 1-16, the cooktop 12 includes multiple grate assemblies 10, which may have one or more of the configurations as described herein. The grate assembly 10 supports the cooking receptacle while proving increased stability to the grate 26. The grates 26 and the gaskets 32 may have multiple configurations depending on the configuration of the cooktop 12. The gasket 32 is configured to retain the grate 26 in a selected position relative to the heat shield 14, which provides increased stability for the grate 26 and reduces movement of the grate 26. Additionally, certain configurations of the heat shield 14 are configured to provide the seal between the heat shield 14 and the cooktop 12. Additionally, the gaskets 32 may increase the efficiency of a manufacturing and assembly process. Each gasket 32 may be constructed of an elastically deformable material to provide the interference or frictional engagement with the heat shield 14, the grate 26, the cooktop 12, or a combination thereof.

Use of the present device may provide for a variety of advantages. For example, the gasket 32 may provide the seal between the heat shield 14 and the cooktop 12. Additionally, the gasket 32 engaging the heat shield 14 may assist in retaining the heat shield 14 in a selected position relative to the cooktop 12. Further, the gasket 32 may provide the interference or frictional engagement with the grate 26, which may retain the grate 26 in the selected position relative to the heat shield 14. Additionally, the gasket 32 may be advantageous for providing additional stability to the grate 26. Increased stability may be advantageous when the grate 26 is supporting the cooking receptacle and a consumer is using the cooktop 12. Further, the interference or frictional engagement between the gasket 32 and the heat shield 14 and/or the grate 26 may retain the selected components relative to one another during the assembly process, which may increase the efficiency of the manufacturing process. Additional benefits or advantages may be realized and/or achieved.

The device disclosed herein is further summarized in the following paragraphs and is further characterized by combinations of any and all of the various aspects described therein.

According to an aspect of the present disclosure, a cooktop grate assembly includes a heat shield having an outer rim and a central plateau region offset from the outer rim by a connecting wall. The central plateau region defines an opening for receiving a burner assembly. A grate is positioned over the heat shield. The grate includes supports that extend over the central plateau region. A gasket is disposed adjacent to the heat shield. The gasket engages at least one of a base of the grate and feet of the supports to retain the grate in position relative to the heat shield.

According to another aspect, a gasket is an insert that extends through an aperture defined in a connecting wall of a heat shield to engage a base of a grate when the base is positioned adjacent to an outer rim of the heat shield.

According to another aspect, a gasket is a border member that defines a groove. An outer edge of a heat shield is disposed within the groove.

According to another aspect, a border member includes outwardly extending projections. Feet of a grate are positioned on the outwardly extending projections.

According to another aspect, a gasket is a sealing insert including a seal member and retention features extending from the seal member.

According to another aspect, a seal member is disposed adjacent to an interior surface of an outer rim of a heat shield and retention features extend through apertures defined by the outer rim to engage a base of a grate.

According to another aspect, retention features are U-shaped to receive a base of a grate.

According to another aspect of the present disclosure, a grate assembly for a cooktop includes a heat shield with a central plateau region offset from an outer rim via a connecting wall. The heat shield has an interior surface oriented toward said cooktop and an exterior surface. A grate is selectively positioned over the heat shield. The grate includes a base disposed adjacent to the outer rim and supports extending from the base and over the central plateau region. A gasket is coupled to the heat shield. The gasket extends from proximate to the interior surface, through the heat shield, to proximate the exterior surface to engage the grate.

According to another aspect, a gasket includes a seal member extending adjacent to an interior surface of an outer rim and adjacent to an outer edge of a heat shield.

According to another aspect, an outer rim defines apertures. Retention features extend from a seal member and through the apertures to engage a base of a grate.

According to another aspect, retention features are U-shaped for receiving a base of a grate. The base is spaced from an outer rim by the retention features.

According to another aspect, a gasket includes a plurality of wall inserts. Each wall insert extends through an aperture defined by a connecting wall of a heat shield.

According to another aspect, a plurality of wall inserts protrude from an exterior surface of a connecting wall to engage an inner surface of a base of a grate when the base is positioned adjacent to an outer rim of a heat shield.

According to another aspect, each wall insert defines a groove configured to receive a heat shield to couple the wall inserts to the heat shield.

According to another aspect, a heat shield defines indents, and feet of a grate are disposed within the indents.

According to another aspect, a heat shield defines an aperture between adjacent indents. A gasket at least partially extends through each aperture.

According to another aspect of the present disclosure, a grate assembly for a cooktop includes a heat shield with an outer rim and a central plateau region. The heat shield includes a curved outer edge. A grate is positioned over the heat shield. The grate includes supports and each support has feet selectively positioned adjacent to the outer rim. A gasket is disposed partially below the heat shield. The gasket defines a groove configured to receive the curved outer edge of the heat shield. The feet of the grate are positioned on projections of the gasket to retain the grate in position relative to the heat shield.

According to another aspect, a gasket has an upper curved portion configured to abut an interior surface of an outer rim adjacent to an outer edge.

According to another aspect, each projection defines a recess configured to receive feet, respectively.

According to another aspect, a gasket is a border member forming a ring extending about a perimeter of the heat shield.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes, and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooktop grate assembly, comprising:

a heat shield having an outer rim and a central plateau region offset from the outer rim by a connecting wall, wherein the central plateau region defines an opening for receiving a burner assembly and wherein the heat shield defines indents;

a grate positioned over the heat shield, wherein the grate includes a base and supports that extend from the base and over the central plateau region, and wherein the supports include feet disposed proximate to the outer rim and within the indents; and a gasket disposed adjacent to the heat shield, wherein the gasket engages the base of the grate to retain the grate in position relative to the heat shield.

2. The cooktop grate assembly of claim 1, wherein the gasket is an insert that extends through an aperture defined in the connecting wall of the heat shield to engage the base of the grate when the base is positioned adjacent to the outer rim of the heat shield.

3. The cooktop grate assembly of claim 1, wherein the gasket is a sealing insert including a seal member and retention features extending from the seal member.

4. The cooktop grate assembly of claim 3, wherein the seal member is disposed adjacent to an interior surface of the outer rim of the heat shield, and wherein the retention features extend through apertures defined by the outer rim to engage the base of the grate.

5. The cooktop grate assembly of claim 3, wherein the retention features are U-shaped to receive the base of the grate.

6. A grate assembly for a cooktop, comprising:

a heat shield including a central plateau region offset from an outer rim via a connecting wall, wherein the heat shield has an interior surface oriented toward said cooktop and an exterior surface;

a grate selectively positioned over the heat shield, wherein the grate includes a base disposed adjacent to the outer rim and supports extending from the base and over the central plateau region; and a gasket coupled to the heat shield, wherein the gasket extends from proximate to the interior surface, through the heat shield, to proximate the exterior surface to engage the grate.

7. The grate assembly of claim 6, wherein the gasket includes a seal member extending adjacent to the interior surface of the outer rim and adjacent to an outer edge of the heat shield.

8. The grate assembly of claim 7, wherein the outer rim defines apertures, and wherein retention features extend from the seal member and through the apertures to engage the base of the grate.

9. The grate assembly of claim 8, wherein the retention features are U-shaped for receiving the base of the grate, and wherein the base is spaced from the outer rim by the retention features.

10. The grate assembly of claim 6, wherein the gasket includes a plurality of wall inserts, wherein each wall insert extends through an aperture defined by the connecting wall of the heat shield.

11. The grate assembly of claim 10, wherein the plurality of wall inserts protrude from the exterior surface of the connecting wall to engage an inner surface of the base of the grate when the base is positioned adjacent to the outer rim of the heat shield.

12. The grate assembly of claim 10, wherein each wall insert defines a groove configured to receive the heat shield to couple the wall inserts to the heat shield.

13. The grate assembly of claim 6, wherein the heat shield defines indents, and wherein feet of the grate are disposed within the indents.

14. The grate assembly of claim 13, wherein the heat shield defines an aperture between adjacent indents, wherein the gasket at least partially extends through each aperture.

15. A grate assembly for a cooktop, comprising:

a heat shield including an outer rim and a central plateau region, wherein the heat shield includes a curved outer edge;

a grate positioned over the heat shield, wherein the grate includes supports, and wherein each support has feet selectively positioned adjacent to the outer rim; and a gasket disposed partially below the heat shield, wherein the gasket defines a groove configured to receive the curved outer edge of the heat shield, and wherein the feet of the grate are positioned on projections of the gasket to retain the grate in position relative to the heat shield, and further wherein each projection defines a recess configured to receive the feet, respectively.

16. The grate assembly of claim 15, wherein the gasket has an upper curved portion configured to abut an interior surface of the outer rim adjacent to the outer edge.

17. The grate assembly of claim 15, wherein the gasket is a border member forming a ring extending about a perimeter of the heat shield.

* * * * *